US010475395B2

(12) United States Patent
Zha

(10) Patent No.: US 10,475,395 B2
(45) Date of Patent: Nov. 12, 2019

(54) DISPLAY METHOD AND DEVICE OF DYNAMICALLY CONTROLLING BACKLIGHT

(71) Applicant: Wuhan China Star Optoelectronics Technology Co., Ltd., Wuhan, Hubei (CN)

(72) Inventor: Guowei Zha, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 172 days.

(21) Appl. No.: 15/556,494

(22) PCT Filed: Jul. 21, 2017

(86) PCT No.: PCT/CN2017/093838

§ 371 (c)(1),
(2) Date: Sep. 7, 2017

(87) PCT Pub. No.: WO2018/223498

PCT Pub. Date: Dec. 13, 2018

(65) Prior Publication Data

US 2018/0357967 A1 Dec. 13, 2018

(30) Foreign Application Priority Data

Jun. 8, 2017 (CN) ..... 2017 1 0428990

(51) Int. Cl.
*G09G 3/34* (2006.01)

(52) U.S. Cl.
CPC ..... *G09G 3/342* (2013.01); *G09G 2320/0276* (2013.01); *G09G 2320/062* (2013.01)

(58) Field of Classification Search
CPC combination set(s) only.
See application file for complete search history.

(56) References Cited

U.S. PATENT DOCUMENTS

2007/0279372 A1* 12/2007 Brown Elliott ..... G09G 3/3426 345/102
2011/0122168 A1 5/2011 Lee et al.
(Continued)

FOREIGN PATENT DOCUMENTS

| | | | |
|---|---|---|---|
| CN | 101211537 | A | 7/2008 |
| JP | 20100002770 | A | 1/2010 |
| KR | 1020060018383 | A | 9/2007 |

*Primary Examiner* — Amr A Awad
*Assistant Examiner* — Andre L Matthews
(74) *Attorney, Agent, or Firm* — Andrew C. Cheng

(57) ABSTRACT

A display method and a display device of dynamically controlling backlight are provided. The present disclosure obtains a modified grayscale value of the input image in each of partitions by using the whole backlight reference value, the RGBW grayscale values of the input image in each of partitions, the normalized backlight output brightness value, and the spatial distribution function of the backlight brightness in each of partitions. The normalized backlight output brightness value of each of partitions is processed as a real backlight output brightness value which is outputted to a backlight driving circuit. The modified grayscale value is processed as a real grayscale value and then the real grayscale value is outputted to a display panel for display. The backlight and image grayscale of each of partitions are adjusted dynamically, thereby improving contrast space and power consumption and further, normally displaying the HDR contents in the HDR display.

17 Claims, 3 Drawing Sheets

(56) References Cited

U.S. PATENT DOCUMENTS

| | | | | |
|---|---|---|---|---|
| 2013/0106901 | A1* | 5/2013 | Inada | G09G 3/3406 345/600 |
| 2015/0371594 | A1* | 12/2015 | Huang | G09G 3/003 345/690 |
| 2016/0253942 | A1* | 9/2016 | Tseng | G06T 11/001 345/601 |
| 2016/0322006 | A1* | 11/2016 | Chen | G09G 3/3426 |
| 2017/0018231 | A1* | 1/2017 | Liu | G09G 3/3688 |
| 2017/0084232 | A1 | 3/2017 | Yang et al. | |
| 2017/0200405 | A1* | 7/2017 | Li | H04N 1/60 |

* cited by examiner

DISPLAY METHOD AND DEVICE OF DYNAMICALLY CONTROLLING BACKLIGHT

1. FIELD OF THE DISCLOSURE

The present disclosure relates to the field of display technology of a liquid crystal panel, and more particularly, to a display method of dynamically controlling backlight and a device using the method.

2. DESCRIPTION OF RELATED ART

A liquid crystal display (LCD) emerges as a top priority among the conventional display devices owing to its excellent function of regeneration of images. Unfortunately, the overall transmittance of the LCD is merely around 5% because some components arranged in the LCD, such as a liquid crystal layer, a polarizer, a color resistor, has the filter function. The filter function of the LCD is unnecessary and unacceptable for a portable cellphone, a flat panel, etc. A white (W) pixel is added to the arrangement of a conventional red (R), green (G), and blue (B) color resistors in the RGBW display technique. In general, an OC flat layer with the W pixel is substituted for a color resistor layer. The OC flat layer with the W pixel is highly transmitted while the color resistor layer is lowly transmitted. Therefore, the RGBW-pixel arrangement has an advantage of higher brightness and lower power consumption compared with the RGB-pixel arrangement.

The brightness of an LCD module of the related art where the R,G, and B pixels are arranged reaches the level of 400 nits to 500 nits. The transmittance of the W subpixel is about 100% to 150% greater than the transmittance of the R,G, and B pixels so that the uppermost brightness around 700 nits to 1200 nits can be achieved. The core of the high dynamic range (HDR) technique is to provide contrast space with a magnitude of up to 104 to match human eyes' recognition range of contrast, thereby recovering the perception of human eyes' to the real world. As for the digital image encoding technique, the 10 bit encoding is necessary to build up the contrast space with a magnitude of 104 so some mainstream HDR unions, such as UHDA and Dolby, regulate the brightness of the HDR display with a support of at least about 800 nits to 1000 nits. The maximal brightness of a mobile terminal of the LCD technique of the related art where the R, G, and B pixels are arranged is generally about 500 nits, which is limited to the feature of low transmittance in the LCD technique of the related art and fails to fulfil the critical requirement of the mobile terminal to power consumption and sustainability. So the requirement of the HDR display technique for hardware cannot be fulfilled.

In addition, the source of the HDR video image resources is very limited at the current stage. In general, the non-HDR videos display depends on concrete grayscale encoding rather the real brightness at the image-collecting terminal. Therefore, as for low saturation and high grayscale encoding, such as (255,255,255), the brightness of the non-HDR display usually is the greatest. As for the HDR display with the high brightness, the brightness of the whole frame of the image reaches 1000 nits after being processed as mentioned above, thereby producing dazzling effects and causing the HDR display to consume a large amount of power.

SUMMARY

An object of the present disclosure is to propose a display method of dynamically controlling backlight and a device using the method to solve the problem that the contents of non-HDR is incompatible with the HDR display in the related art.

According to one aspect of the present disclosure, a display method of dynamically controlling backlight comprises: normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain; the whole backlight reference value is calculated based on the mean of the grayscale peak value of the whole frame of the input image; and processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display.

According to another aspect of the present disclosure, a display device comprises a backlight driving circuit and a processor coupled to the backlight driving circuit. The processor is configured to execute instructions to perform operations of:

normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain; the whole backlight reference value is calculated based on the mean of the grayscale peak value of the whole frame of the input image;

processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display.

According to another aspect of the present disclosure, a display device includes a storage storing instructions. The instructions are executed by a processor to perform operations of:

normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain; the whole backlight reference value is calculated based on the mean of the grayscale peak value of the whole frame of the input image;

processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display.

The present disclosure brings benefits as follows. Different from the related art, the present disclosure proposes a display method of dynamically controlling backlight of normalizing a red (R) grayscale value, a green (G) grayscale value, and a blue (B) grayscale value of an obtained whole frame of an input image, and dividing the whole frame of the input image into a plurality of partitions, obtaining the normalized backlight output brightness value of each of the plurality of partitions by using the mean of the grayscale peak value of the input image and a brightness gain of the input image in each of the plurality of partitions, obtaining a modified grayscale value of the input image in each of the plurality of partitions by using the whole backlight reference value, the RGBW grayscale values of the input image in each of the plurality of partitions, the normalized backlight output brightness value, and the spatial distribution function of the backlight brightness in each of the plurality of partitions, processing the normalized backlight output brightness value of each of the plurality of partitions to be a real backlight output brightness value, outputting the real backlight output brightness value to a backlight driving circuit, and processing the modified grayscale value to be a real grayscale value and then outputting the real grayscale value to a display panel for display. In the present disclosure, a front backlight reference value is obtained after the grayscale peak value of the whole frame of the input image is calculated. The RGBW gain values of the input image of each of the plurality of partitions are determined; the backlight and image grayscale of each of the plurality of partitions are adjusted dynamically, thereby improving contrast space and power consumption and further, normally displaying the HDR contents in the HDR display.

DETAILED DESCRIPTION OF THE EMBODIMENTS

To help a person skilled in the art better understand the solutions of the present disclosure, the following clearly and completely describes the technical solutions in the embodiments of the present invention with reference to the accompanying drawings in the embodiments of the present invention.

"Grayscale" in the present embodiment indicates multiple levels of the brightness ranging from the brightest part to the darkest part so as to control the screen brightness which signal input corresponds to. Each digital image includes a plurality of spots, which are called pixels. Each of the plurality of pixels has a variety of colors. The color includes red (R), green (G), and blue (B) subpixels. The light source behind each of the subpixels shows different brightness levels. Grayscale represents different brightness levels ranging from the darkest part to the brightest part. The image display becomes more delicate if the number of brightness levels ranging from the darkest part to the brightest part is more. Take an 8 bit panel for example. Two to the power of eight is shown, that is, equal to 256 brightness levels, which is called 256 grayscale. The red, green, and blue color with diverse brightness levels form each of the pixels on an LCD screen to form various color spots finally. In other words, the color variations of each of the spots on the screen are the outcomes of grayscale of the R, G, and B subpixels forming each of the spots.

Figure 1:
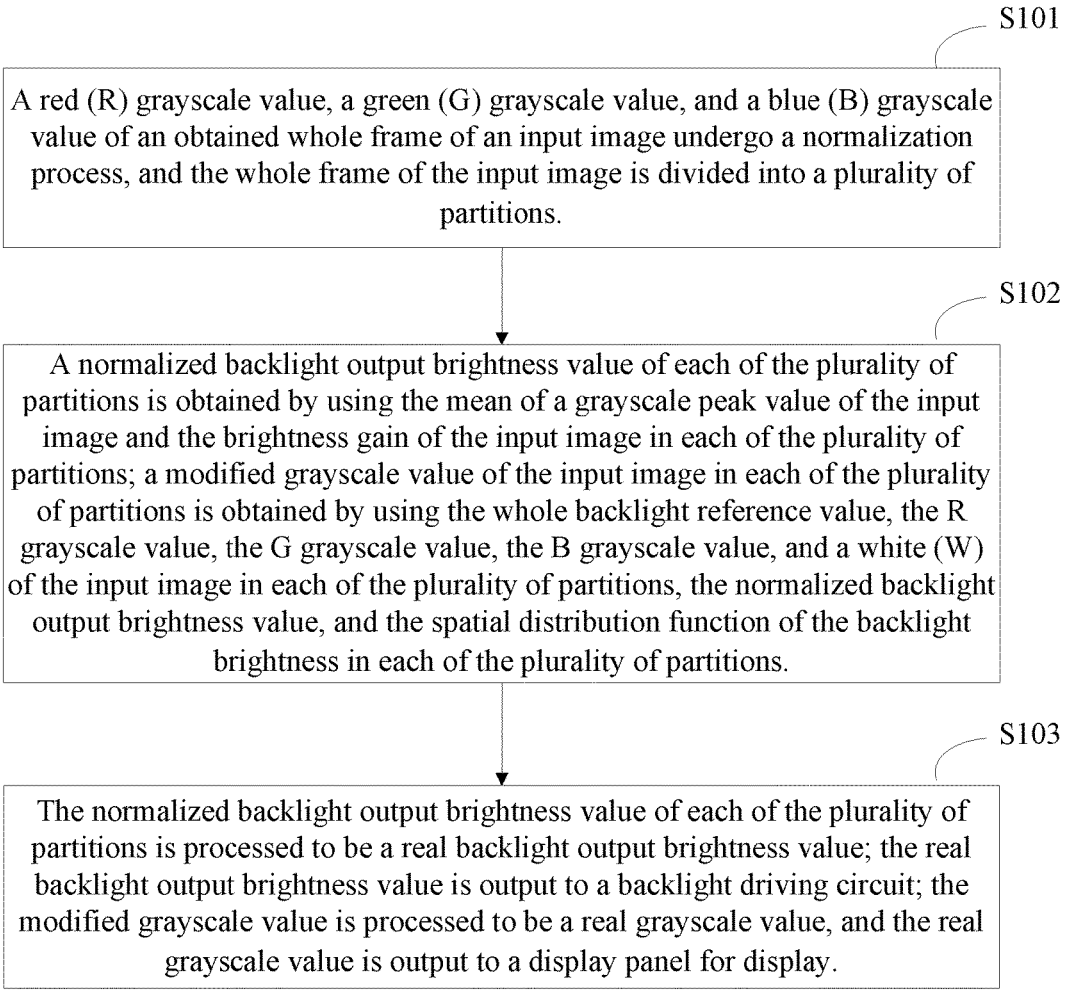
FIG. 1 illustrates a flowchart of a display method of dynamically controlling backlight according to a first embodiment of the present disclosure.

Please refer to FIG. 1 illustrating a flowchart of a display method of dynamically controlling backlight according to a first embodiment of the present disclosure. The display method of dynamically controlling backlight includes block S101, block S102, and block S103.

At block S101, a red (R) grayscale value, a green (G) grayscale value, and a blue (B) grayscale value of an obtained whole frame of an input image undergo a normalization process, and the whole frame of the input image is divided into a plurality of partitions.

Specifically, the obtained grayscale values are projected to the range of zero to one (0~1) for processing to set the maximal value of the RGB grayscale values of the whole frame of the input image to be one.

In the present embodiment, the whole frame of the input image is divided into a plurality of partitions according to the backlight partition method. The number of the plurality of partitions is generally an integer of four or more. A person skilled in the art can decide how many partitions are proper based on the practical display effect. The number of partitions is not limited in the present disclosure.

At block S102, a normalized backlight output brightness value of each of the plurality of partitions is obtained by using the mean of a grayscale peak value of the input image and the brightness gain of the input image in each of the plurality of partitions; a modified grayscale value of the input image in each of the plurality of partitions is obtained by using the whole backlight reference value, the R grayscale value, the G grayscale value, the B grayscale value, and a white (W) of the input image in each of the plurality of partitions, the normalized backlight output brightness value, and the spatial distribution function of the backlight brightness in each of the plurality of partitions.

Specifically, the whole backlight reference value can be obtained according to a specific algorithm. A modified grayscale value of the input image in each of the plurality of partitions can be obtained after the RGBW grayscale values of the input image in each of the plurality of partitions, the normalized backlight brightness value, and the spatial distribution function of the backlight brightness in each of the plurality of partitions are calculated according to another algorithm.

The brightness gain is the minimal value of all pixel gains in the partition or a gain with a specific threshold level among all of the pixel gains (only a small number of pixel gains with some differences in threshold gains to prevent visual color difference due to large-area pure color shift). The gain with a specific threshold level ranges from 0.01 to 0.2.

At block S103, the normalized backlight output brightness value of each of the plurality of partitions is processed to be a real backlight output brightness value; the real backlight output brightness value is output to a backlight driving circuit; the modified grayscale value is processed to be a real grayscale value, and the real grayscale value is output to a display panel for display.

Specifically, the real backlight output brightness value of each of the plurality of partitions can be obtained according to a specific algorithm to output the real backlight output brightness value to the backlight driving circuit. Meanwhile, the real grayscale value can be obtained according to a specific algorithm and output to the display panel for display.

The real backlight output brightness value and the real grayscale value recover the normalized backlight output brightness value and the grayscale value of each of the plurality of partitions recover to be non-normalized values.

In the present embodiment, the modified grayscale value of the input image in each of the plurality of partitions is obtained by using the whole backlight reference value, the RGBW grayscale values of the input image in each of the plurality of partitions, the normalized backlight output brightness value, and the spatial distribution function of the backlight brightness in each of the plurality of partitions. Afterwards, the normalized backlight output brightness value of each of the plurality of partitions is processed to be a real backlight output brightness value; the real backlight output brightness value is output to a backlight driving circuit; the modified grayscale value is processed to be a real grayscale value, and the real grayscale value is output to a display panel for display. Therefore, the HDR contents are compatible with the non-HDR contents in display, which prevents dazzling images due to the high brightness of the whole frame of the images of the non-HDR contents.

Figure 2:
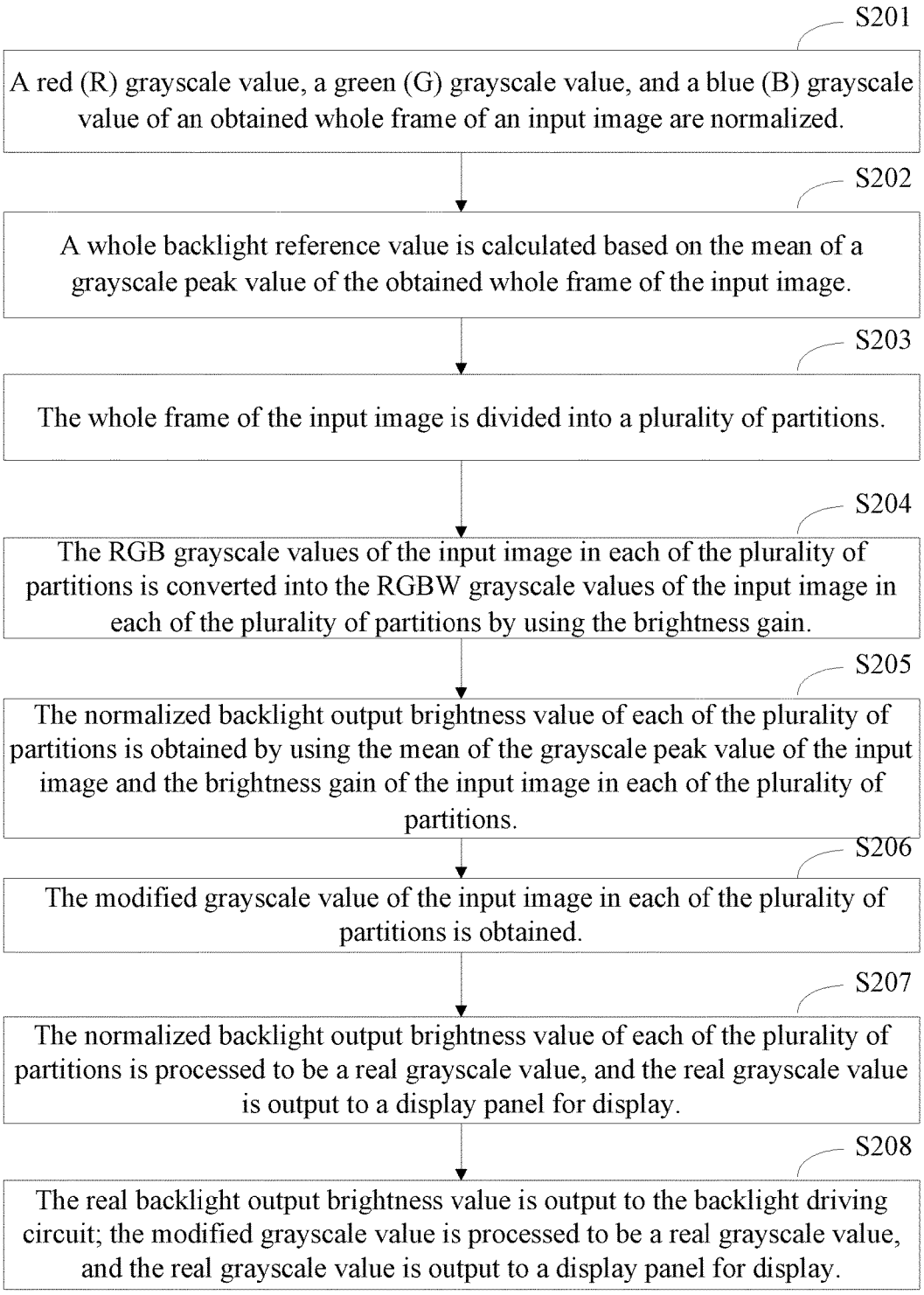
FIG. 2 illustrates a flowchart of a display method of dynamically controlling backlight according to a second embodiment of the present disclosure.

Please refer to FIG. 2 illustrating a flowchart of a display method of dynamically controlling backlight according to a second embodiment of the present disclosure. The display method of dynamically controlling backlight includes block S201, block S202, block S203, block S204, block S205, block S206, block S207, and block S208.

At block S201, a red (R) grayscale value, a green (G) grayscale value, and a blue (B) grayscale value of an obtained whole frame of an input image are normalized.

At block S202, a whole backlight reference value is calculated based on the mean of a grayscale peak value of the obtained whole frame of the input image.

In the present disclosure, the whole backlight reference value can be calculated according to the formula of BLUconst=min(1,f(Lmean)). BLUconst indicates the whole backlight reference value. Lmean indicates the mean of the grayscale peak value of the whole frame of the input image in each of the plurality of partitions. When Lmean≤GT stands, f(Lmean)=1 is true. When Lmean=1 stands, f(Lmean)=LT is true. When GT≤Lmean≤1 stands, f(Lmean)∈[LT,1] is true. Besides, f(Lmean)∈[LT,1] is the function Lmean of monotonical decrease. LT indicates the backlight brightness threshold value. GT indicates the threshold value of the mean of the grayscale peak value. The grayscale peak value is the maximal value of the RGB grayscales.

Figure 3:
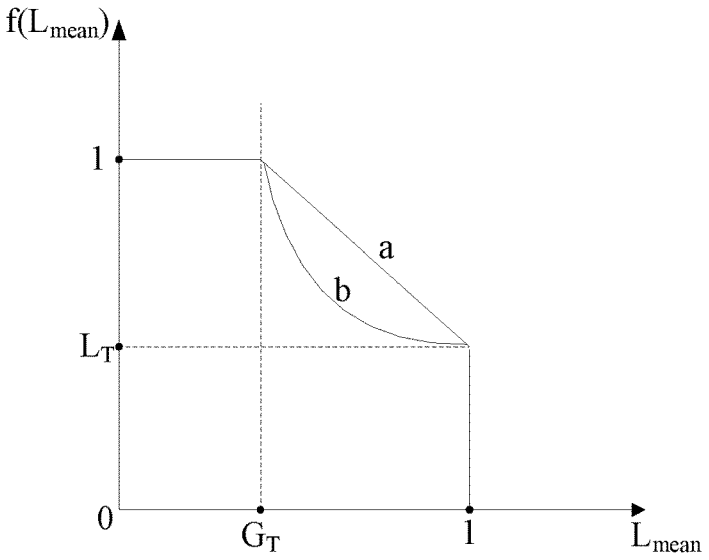
FIG. 3 illustrates a diagram of the function of mean of the grayscale peak value of the whole frame of the input image in the display method of dynamically controlling backlight according to the present embodiment of the present disclosure.

Please refer to FIG. 3 illustrating a schematic diagram of the function of mean of the grayscale peak value of the whole frame of the input image in the display method of dynamically controlling backlight according to the present embodiment of the present disclosure.

As FIG. 3 illustrates, Lmean indicates the mean of the grayscale peak value of the whole frame of the input image. When Lmean≤GT stands, f(Lmean)=1 is true. When Lmean=1 stands, f(Lmean)=LT is true. When GT≤Lmean≤1 stands, f(Lmean) is curves a and b illustrated in FIG. 3 or any other functions which can satisfy f(Lmean)∈[GT,1]. When GT≤Lmean≤1 stands, f(Lmean) gradually decreases with an increase in the mean Lmean of the grayscale peak value of the whole frame of the input image. In another embodiment, curve a is chosen, and the average grayscale brightness on the horizontal axis has undergone an linear process.

In another embodiment, the value of GT and the value of LT are GT=0.3 and LT=0.6 correspondingly.

When the mean Lmean of the grayscale peak value of the whole frame of the input image is too great, the backlight threshold value brightness LT is set, and the whole backlight reference value BLUconst is assigned to be smaller than the maximally specific threshold value to prevent dazzling images and to consume less power. Meanwhile, when the mean Lmean of the grayscale peak value of the whole frame of the input image is less than the threshold value of the mean of the grayscale peak value GT, the assigned whole backlight reference value BLUconst is the maximal value, that is, one, to prevent too dim images, which ensures that the brightness of the images is proper.

At block S203, the whole frame of the input image is divided into a plurality of partitions.

At block S204, the RGB grayscale values of the input image in each of the plurality of partitions is converted into the RGBW grayscale values of the input image in each of the plurality of partitions by using the brightness gain.

In the present disclosure, the RGBW grayscale values of the converted input image are obtained according to the formula of Ro=gain*Rin−Wo; Go=gain*Gin−Wo; Bo=gain*Bin; Wo=g(Rin,Gin,Bin).

Ro, Go, Bo, and Wo respectively correspond to the converted red, green, blue, and white grayscale values of the input image in each of the plurality of partitions. Rin, Gin, and Bin respectively correspond to the red, green, and blue grayscale values of the input image in each of the plurality of partitions before the red, green, and blue grayscale values are converted. Gain indicates the brightness gain.

In the present disclosure, the function g(Rin,Gin,Bin) usually depends on saturation of some pixel, which is not limited by the present disclosure. In any one of partitions, the increase in the brightness of a pixel with an ordinary pure color is not obvious when the RGB are converted into RGBW; the increase in the brightness of a pixel with a low pure color is comparatively obvious when the RGB are converted into RGBW. To prevent visual color difference of different pure colors in the same partition because of the difference in the brightness gain, the brightness gain is the minimal value of all pixel gains in the partition or a gain with a specific threshold level among all of the pixel gains (only a small number of pixel gains with some differences in threshold gains to prevent visual color difference due to large-area pure color shift). The gain with a specific threshold level ranges from 0.01 to 0.2.

At block S205, the normalized backlight output brightness value of each of the plurality of partitions is obtained by using the mean of the grayscale peak value of the input image and the brightness gain of the input image in each of the plurality of partitions.

In the present disclosure, the normalized backlight output brightness value of each of the plurality of partitions can be calculated according to the formula of BLUout=L'mean/gain. BLUout indicates the normalized backlight output brightness value of each of the plurality of partitions. L'mean indicates the mean of the grayscale peak value of the input image in each of the plurality of partitions; gain indicates the brightness gain.

At block S206, the modified grayscale value of the input image in each of the plurality of partitions is obtained.

In the present disclosure, the modified grayscale value of the input image in each of the plurality of partitions can be calculated according to the formula of Lout=min(1, BLUconst*Lo/(BLUout*h(x,y))). Lout indicates the modified grayscale value of the input image in each of the plurality of partitions. Lo indicates the grayscale value of the input image in each of the plurality of partitions before modification, including the above-mentioned Ro, Go, Bo, and Wo. Ro, Go, Bo, and Wo respectively correspond to the converted red, green, blue, and white grayscale values of the input image in each of the plurality of partitions. Gain indicates the brightness gain. BLUconst indicates the whole backlight reference value. BLUout indicates the normalized backlight output brightness value of each of the plurality of partitions. The function of h(x,y) indicates the spatial distribution function of the backlight brightness in each of the plurality of partitions.

It is notified that the function h(x,y) depends on the design of module hardware.

At block S207, the normalized backlight output brightness value of each of the plurality of partitions is processed to be a real grayscale value, and the real grayscale value is output to a display panel for display.

In the present disclosure, the real backlight output brightness value of each of the plurality of partitions can be calculated according to the formula of BLU=BLUout*BLUmax. BLU indicates the real backlight output brightness value of each of the plurality of partitions. BLUout indicates the normalized backlight output brightness value of each of the plurality of partitions. BLUmax indicates the maximal value of the backlight brightness of each of the plurality of partitions.

At block S208, the real backlight output brightness value is output to the backlight driving circuit; the modified grayscale value is processed to be a real grayscale value, and the real grayscale value is output to a display panel for display.

Accordingly, the present disclosure obtains a modified grayscale value of the input image in each of the plurality of partitions by using the whole backlight reference value, the RGBW grayscale values of the input image in each of the plurality of partitions, the normalized backlight output brightness value, and the spatial distribution function of the backlight brightness in each of the plurality of partitions. The normalized backlight output brightness value of each of the plurality of partitions is processed to be a real backlight output brightness value. The real backlight output brightness value is outputted to a backlight driving circuit. The modified grayscale value is processed to be a real grayscale value and then the real grayscale value is outputted to a display panel for display. In the present disclosure, a front backlight reference value is obtained after the grayscale peak value of the whole frame of the input image is calculated. The RGBW gain values of the input image of each of the plurality of partitions are determined. The backlight and image grayscale of each of the plurality of partitions are adjusted dynamically, thereby improving contrast space and power consumption and further, normally displaying the HDR contents in the HDR display.

Figure 4:
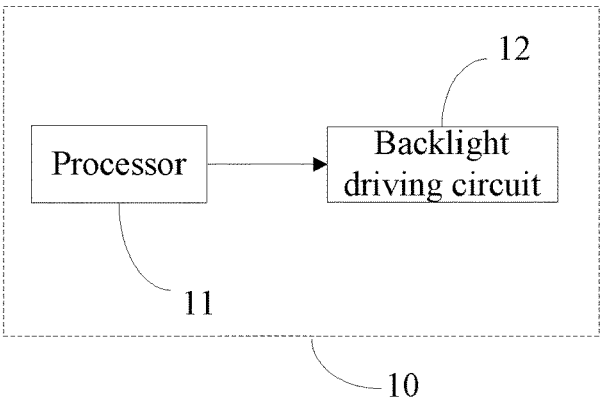
FIG. 4 illustrates a schematic diagram of the structure of a display device according to a third embodiment of the present disclosure.

Please refer to FIG. 4 illustrating a schematic diagram of the structure of a display device 10 according to a third embodiment of the present disclosure. The display device 10 includes a processor 11 and a backlight driving circuit 12. The processor 11 is coupled to the backlight driving circuit 12. The processor 11 performs instructions at work to realize a display method of dynamically controlling backlight as introduced above.

Figure 5:
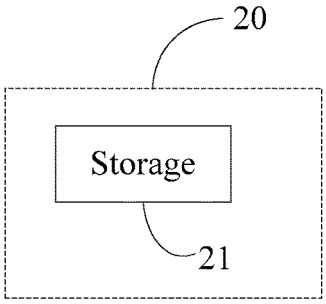
FIG. 5 illustrates a block diagram of a device 20 with the saving function according to a fourth embodiment of the present disclosure.

Please refer to FIG. 5 illustrating a block diagram of a display device 20 according to a fourth embodiment of the present disclosure. The display device 20 stores instructions executable by a processor to perform a display method of dynamically controlling backlight as provided above.

The display device 20 may include a storage 21. The storage 21 is configured to save instructions.

The present disclosure brings benefits as follows. Different from the related art, the present disclosure proposes a display method of dynamically controlling backlight of normalizing a red (R) grayscale value, a green (G) grayscale value, and a blue (B) grayscale value of an obtained whole frame of an input image, and dividing the whole frame of the input image into a plurality of partitions, obtaining the normalized backlight output brightness value of each of the plurality of partitions by using the mean of the grayscale peak value of the input image and a brightness gain of the input image in each of the plurality of partitions. Accordingly, the present disclosure obtains a modified grayscale value of the input image in each of the plurality of partitions by using the whole backlight reference value, the RGBW grayscale values of the input image in each of the plurality of partitions, the normalized backlight output brightness value, and the spatial distribution function of the backlight brightness in each of the plurality of partitions. The normalized backlight output brightness value of each of the plurality of partitions is processed to be a real backlight output brightness value. The real backlight output brightness value is outputted to a backlight driving circuit. The modified grayscale value is processed to be a real grayscale value and then the real grayscale value is outputted to a display panel for display. In the present disclosure, a front backlight reference value is obtained after the grayscale peak value of the whole frame of the input image is calculated. The RGBW gain values of the input image of each of the plurality of partitions are determined. The backlight and image grayscale of each of the plurality of partitions are adjusted dynamically, thereby improving contrast space and power consumption and further, normally displaying the HDR contents in the HDR display.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A display method of dynamically controlling backlight, comprising:

normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain; the whole backlight reference value is calculated based on the mean of the grayscale peak value of the whole frame of the input image;

processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display;

wherein the whole backlight reference value is BLUconst=min(1,f(Lmean)), where BLUconst indicates the whole backlight reference value; Lmean indicates the mean of the grayscale peak value of the whole frame of the input image in each of the plurality of partitions; when Lmean≤GT stands, f(Lmean)=1 is true; when Lmean=1 stands, f(Lmean)=LT is true; when GT≤Lmean≤1 stands, f(Lmean)∈[LT,1] is true; f(Lmean)∈[LT,1] is the function Lmean of monotonical decrease; LT indicates a backlight brightness threshold value; GT indicates a threshold value of the mean of the grayscale peak value.

2. The method of claim 1, wherein the RGBW grayscale values of the input image are Ro=gain*Rin-Wo; Go=gain*Gin-Wo; Bo=gain*Bin; Wo=g(Rin,Gin,Bin), where Ro, Go, Bo, and Wo respectively correspond to the converted red, green, blue, and white grayscale values of the input image in each of the plurality of partitions; Rin, Gin, and Bin respectively correspond to the red, green, and blue grayscale values of the input image in each of the plurality of partitions before the red, green, and blue grayscale values are converted; gain indicates the brightness gain.

3. The method of claim 1, wherein the normalized backlight output brightness value in each of the plurality of partitions is BLUout=L'mean/gain, where BLUout indicates the normalized backlight output brightness value in each of the plurality of partitions; L'mean indicates the mean of the grayscale peak value of the input image in each of the plurality of partitions; gain indicates the brightness gain.

4. The method of claim 1, wherein the modified grayscale value of the input image in each of the plurality of partitions is Lout=min(LBLUconst*Lo/(BLUout*h(x,y))), where Lout indicates the modified grayscale value of the input image in each of the plurality of partitions, where Lo indicates the grayscale value of the input image in each of the plurality of partitions before being modified, comprising the Ro, Go, Bo and Wo; BLUconst indicates the whole backlight reference value; BLUout indicates the normalized backlight output brightness value in each of the plurality of partitions; the function h(x,y) indicates the spatial distribution function of the backlight brightness in each of the plurality of partitions.

5. The method of claim 1, wherein the real backlight output brightness value is BLU=BLUout*BLUmax, where BLU indicates the real backlight output brightness value in each of the plurality of partitions; BLUout indicates the normalized backlight output brightness value in each of the plurality of partitions; BLUmax indicates a maximal value of the backlight brightness in each of the plurality of partitions.

6. The method of claim 1, wherein the grayscale peak value is a maximal value of the RGB grayscale.

7. The method of claim 1, wherein the dividing the whole frame of the input image into the plurality of partitions comprises:

dividing the whole frame of the input image into the plurality of partitions according to the method of backlight partition.

8. A display device, comprising:

a backlight driving circuit;

a processor, coupled to the backlight driving circuit and configured to execute instructions to perform operations of:

normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain;

the whole backlight reference value is calculated based on the mean of the grayscale peak value of the whole frame of the input image;

processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display;

wherein the processor executes the instructions to calculate the whole backlight reference value BLUconst according to a formula:

$$BLU\text{const}=\min(1,f(L\text{mean})),$$

where BLUconst indicates the whole backlight reference value; Lmean indicates the mean of the grayscale peak value of the whole frame of the input image in each of the plurality of partitions; when Lmean≤GT stands, f(Lmean)=1 is true; when Lmean=1 stands, f(Lmean)=LT is true; when GT≤Lmean≤1 stands, f(Lmean)∈[LT,1] is true; f(Lmean)∈[LT,1] is the function Lmean of monotonical decrease; LT indicates a backlight brightness threshold value; GT indicates a threshold value of the mean of the grayscale peak value.

9. The display device of claim 8, wherein the processor executes the instructions to calculate the RGBW grayscale values of the input image according to formulas:

$$Ro=\text{gain}*Rin-Wo;\ Go=\text{gain}*Gin-Wo;\ Bo=\text{gain}*Bin;\ Wo=g(Rin,Gin,Bin),$$

where Ro, Go, Bo, and Wo respectively correspond to the converted red, green, blue, and white grayscale values of the input image in each of the plurality of partitions; Rin, Gin, and Bin respectively correspond to the red, green, and blue grayscale values of the input image in each of the plurality of partitions before the red, green, and blue grayscale values are converted; gain indicates the brightness gain.

10. The display device of claim 8, wherein the processor executes the instructions to calculate the normalized backlight output brightness value BLUout in each of the plurality of partitions according to a formula:

$$BLU\text{out}=L'\text{mean}/\text{gain},$$

where BLUout indicates the normalized backlight output brightness value in each of the plurality of partitions; L'mean indicates the mean of the grayscale peak value of the input image in each of the plurality of partitions; gain indicates the brightness gain.

11. The display device of claim 8, wherein the processor executes the instructions to calculate the modified grayscale value Lout of the input image in each of the plurality of partitions according to a formula Lout=min(LBLUconst*Lo/(BLUout*h(x,y))), where Lout indicates the modified grayscale value of the input image in each of the plurality of partitions, where Lo indicates the grayscale value of the input image in each of the plurality of partitions before being modified, comprising the Ro, Go, Bo and Wo; BLUconst indicates the whole backlight reference value; BLUout indicates the normalized backlight output brightness value in each of the plurality of partitions; the function h(x,y) indicates the spatial distribution function of the backlight brightness in each of the plurality of partitions.

12. The display device of claim 8, wherein the processor executes the instructions to calculate the real backlight output brightness value according to a formula:

$$BLU=BLU\text{out}*BLU\text{max},$$

where BLU indicates the real backlight output brightness value in each of the plurality of partitions; BLUout indicates the normalized backlight output brightness value in each of the plurality of partitions; BLUmax indicates a maximal value of the backlight brightness in each of the plurality of partitions.

13. A display device comprising a storage storing instructions, the instructions executed by a processor to perform operations of:

normalizing a red (R) grayscale value, a green (G) grayscale value, and a blue (B) grayscale value of an obtained whole frame of an input image, and dividing the whole frame of the input image into a plurality of partitions;

obtaining a normalized backlight output brightness value of each of the plurality of partitions by using the mean of a grayscale peak value of the input image and a brightness gain of the input image in each of the plurality of partitions; obtaining a modified grayscale value of the input image in each of the plurality of partitions by using a whole backlight reference value, the R, G, and B grayscale values and a white (W) grayscale value of the input image in each of the plurality of partitions, the normalized backlight output brightness value, and a spatial distribution function of the backlight brightness in each of the plurality of partitions wherein the RGB grayscale values of the input image are converted into the RGBW grayscale values of the input image by using the brightness gain; the whole backlight reference value is calculated based on the mean of the grayscale peak value of the whole frame of the input image;

processing the normalized backlight output brightness value of each of the plurality of partitions to be a real backlight output brightness value; outputting the real backlight output brightness value to a backlight driving circuit; processing the modified grayscale value to be a real grayscale value and outputting the real grayscale value to a display panel for display;

wherein the instructions are executed by the processor to calculate the whole backlight reference value BLUconst according to a formula:

$$BLU\text{const}=\min(1,f(L\text{mean})),$$

where BLUconst indicates the whole backlight reference value; Lmean indicates the mean of the grayscale peak value of the whole frame of the input image in each of the plurality of partitions; when Lmean≤GT stands, f(Lmean)=1 is true; when Lmean=1 stands, f(Lmean)=LT is true; when GT≤Lmean≤1 stands, f(Lmean)∈[LT,1] is true; f(Lmean)∈[LT,1] is the function Lmean of monotonical decrease; LT indicates a backlight brightness threshold value; GT indicates a threshold value of the mean of the grayscale peak value.

14. The display device of claim 13, wherein the processor executes the instructions to calculate the RGBW grayscale values of the input image according to formulas:

$$Ro=\text{gain}*Rin-Wo;\ Go=\text{gain}*Gin-Wo;\ Bo=\text{gain}*Bin;\ Wo=g(Rin,Gin,Bin),$$

where Ro, Go, Bo, and Wo respectively correspond to the converted red, green, blue, and white grayscale values of the input image in each of the plurality of partitions; Rin, Gin, and Bin respectively correspond to the red, green, and blue grayscale values of the input image in each of the plurality of partitions before the red, green, and blue grayscale values are converted; gain indicates the brightness gain.

15. The display device of claim 13, wherein the instructions are executed by the processor to calculate the normalized backlight output brightness value BLUout in each of the plurality of partitions according to a formula:

$$BLU\text{out}=L'\text{mean}/\text{gain},$$

where BLUout indicates the normalized backlight output brightness value in each of the plurality of partitions; L'mean indicates the mean of the grayscale peak value of the input image in each of the plurality of partitions; gain indicates the brightness gain.

16. The display device of claim 13, wherein the instructions are executed by the processor to calculate the modified grayscale value Lout of the input image in each of the plurality of partitions according to a formula $$L\text{out}=\min(1,BLU\text{const}*Lo/(BLU\text{out}*h(x,y))),$$

where Lout indicates the modified grayscale value of the input image in each of the plurality of partitions, where Lo indicates the grayscale value of the input image in each of the plurality of partitions before being modified, comprising the Ro, Go, Bo and Wo; BLUconst indicates the whole backlight reference value; BLUout indicates the normalized backlight output brightness value in each of the plurality of partitions; the function h(x,y) indicates the spatial distribution function of the backlight brightness in each of the plurality of partitions.

17. The display device of claim 13, wherein the instructions are executed by the processor to calculate the real backlight output brightness value according to a formula:

$$BLU=BLU\text{out}*BLU\text{max},$$

where BLU indicates the real backlight output brightness value in each of the plurality of partitions; BLUout indicates the normalized backlight output brightness value in each of the plurality of partitions; BLUmax indicates a maximal value of the backlight brightness in each of the plurality of partitions.

* * * * *